US005672401A

United States Patent [19]

Anglin et al.

[11] Patent Number: 5,672,401

[45] Date of Patent: Sep. 30, 1997

[54] LUBRICATED SHEET PRODUCT AND LUBRICANT COMPOSITION

[75] Inventors: James R. Anglin, Export; Julie A. Urbanski, Natrona, both of Pa.; Theresa S. Knighton, Newburgh, Ind.

[73] Assignee: Aluminum Company of America, Pittsburgh, Pa.

[21] Appl. No.: 548,996

[22] Filed: Oct. 27, 1995

[51] Int. Cl.[6] ..... B32B 15/08

[52] U.S. Cl. ..... 428/64.1; 106/270; 106/271; 428/66.2; 428/66.3; 428/66.4; 428/458; 428/461; 428/467; 428/484

[58] Field of Search ..... 428/64.1, 66.2, 428/66.3, 66.4, 458, 461, 467, 484; 106/270, 271

[56] References Cited

U.S. PATENT DOCUMENTS

| | | | |
|---|---|---|---|
| Re. 31,349 | 8/1983 | Smith et al. | 428/623 |
| Re. 32,653 | 4/1988 | Forsberg | 252/33 |
| 3,765,955 | 10/1973 | Kushima et al. | 148/31.5 |
| 3,899,433 | 8/1975 | Unick et al. | 252/52 R |
| 4,144,178 | 3/1979 | Katabe et al. | 252/8.9 |
| 4,321,308 | 3/1982 | Jahnke | 428/469 |
| 4,343,863 | 8/1982 | Lawrence | 428/425 |
| 4,495,156 | 1/1985 | Rohowetz | 427/384 |
| 4,839,202 | 6/1989 | Grassel et al. | 427/424 |
| 4,988,536 | 1/1991 | Van Dongen et al. | 427/39 |
| 5,043,085 | 8/1991 | Kinoshita | 252/49.9 |
| 5,062,928 | 11/1991 | Smith | 204/15 |
| 5,102,567 | 4/1992 | Wolf | 252/46.6 |
| 5,156,720 | 10/1992 | Rosenfeld et al. | 205/76 |
| 5,218,011 | 6/1993 | Freeman | 523/173 |
| 5,354,372 | 10/1994 | Ebayashi | 106/271 |
| 5,401,575 | 3/1995 | Anglin et al. | 428/341 |

FOREIGN PATENT DOCUMENTS

| | | |
|---|---|---|
| 2043382 | 2/1990 | Japan . |
| 4013877 | 1/1992 | Japan . |
| 9106619 | 5/1991 | WIPO . |

*Primary Examiner*—Nasser Ahmad
*Attorney, Agent, or Firm*—Gary P. Topolosky

[57] ABSTRACT

Metal sheet product, more particularly food can stock and beer and beverage can tab, end and body stock, is treated with a lubricant made by blending a mixture consisting essentially of about 25–90 wt.% of: (i) an ester selected from the group consisting of: bis(2-ethylhexyl)sebacate (or DOS), butyl stearate, and an acetylated, partially hydrogenated soybean oil; and (ii) about 10–75 wt.% of a blend consisting essentially of: (a) about 35–65 wt.% of a polyalphaolefin; and (b) about 65–35 wt.% of a microcrystalline wax; with a balance of incidental additives and impurities. With said composition applied thereon, in preferred average thicknesses between about 3–110 mg/ft$^2$ for can tab stock and between about 3–35 mg/ft$^2$ for can end and body stock, the invention produces prelubricated can stock in a suitable condition for conversion without further lubrication.

29 Claims, No Drawings

LUBRICATED SHEET PRODUCT AND LUBRICANT COMPOSITION

BACKGROUND OF THE INVENTION

1. Field of the Invention

This invention relates to lubricating both bare (or uncoated) and coated metal sheet product suitable for use as food, beer and beverage can stock. The invention may also be used for lubricating flexible or formed container stock. More specifically, this invention relates to manufacturing pro-lubricated food can, and beer and beverage can tab and end stock from 5000 Series aluminum alloys (Aluminum Association designations) such as 5017, 5042, 5052, 5082, 5182 and 5352 aluminum. The invention also specifically relates to manufactured pre-lubricated beer and beverage container body stock from 3000 Series aluminum alloys like 3004, 3104 and 3204 and 3204 aluminum. For flexible (or formed) container stock, the lubricant of this invention may be applied to such other aluminum alloys as 1100, 1145, 3003 and 8111 aluminum. An improved food, beer, and beverage can tab and end stock lubricant composition is also described herein.

2. Technology Review

The aluminum industry supplies can manufacturers with millions of pounds of coiled sheet product each year. These manufacturers convert such sheet product into can bodies, ends, and tabs for beer, beverages and certain foodstuffs. These aluminum sheet products are coated with a lubricant composition on one or both surfaces by the sheet supplier, with additional lubricant applied as required by the can maker prior to fabrication of can bodies, ends and tabs therefrom. Lubricant residues on any food or beverage packaging must meet all applicable U.S. Food and Drug Administration (FDA) requirements.

Liquid and solid lubricants are used in metal working operations to reduce and control friction and wear between the surface of metal being worked and surfaces of the apparatus carrying out a given metal working operation. Lubricants reduce and control friction and wear by maintaining a thin film of an appropriate composition between the contacting surfaces in relative motion. Lubricants can also improve tooling cleanliness and lifetime and provide good surface quality on the worked product.

In addition to their friction and wear reducing characteristics, lubricant compositions are expected to fulfill certain other requirements in sheet forming applications. They should: be easy to apply and remove where removal is warranted; afford some protection to the metal surface during handling and storage; present no health hazards to persons coming in contact with the composition; and be inert to the surfaces in contact therewith. For food, beer and beverage packaging, lubricant residues should not affect the characteristics of the packaged product. Some lubricants produce severe stains on the metal surfaces they contact. It is highly desirable to avoid the staining of metal surfaces by using a lubricant of appropriate composition or blend having the properties demanded by the particular conditions under which the metal product will be worked. Good performance of the lubricated sheet on modern, high speed sheet forming equipment is also necessary.

It is known to apply lubricant compositions to aluminum sheet products through numerous methods. One representative means employs a spray coater or atomizer as set forth in Grassel U.S. Pat. No. 4,839,202, the disclosure of which is fully incorporated by reference herein. With the latter device, a lubricant composition consisting of only bis(2-ethylhexyl)sebacate, or sometimes called dioctyl sebacate ("DOS"), is electrostatically deposited to a thickness (or coverage) of about 1 mg/ft$^2$ on both surfaces of the metal. The purchaser of such metal, the can manufacturer, typically uncoils such stock to apply a second lubricant thereon before feeding metal into the fabricating equipment.

Still other known lubricant application means include passing sheet product through any of various applicators which generate fine droplets of lubricant for deposit on said sheet product with electrostatic assistance, or through equipment with one or more rotating rolls designed to transfer lubricant to the sheet from the roll. The lubricant composition/blend of this invention can be applied by any of the foregoing means which can include warming of the lubricant composition as needed. On a less preferred basis, the invention may be added to one or more solvents prior to sheet metal application, said solvent(s) being suitable for evaporation and recovery for reuse. Similarly, blends in water may be applied to the sheet, followed by evaporation of the water.

SUMMARY OF THE INVENTION

It is a principal objective of this invention to provide a lubricant composition for can tab and end stock, both bare and coated, that imparts improved friction and wear performance over prior known compositions. It is another objective to provide coated food can stock, coated food, beer and beverage can end stock and both bare and coated food, beer and beverage can tab stock with a prelubricated surface so as to eliminate, or significantly reduce, the frequency of use and the necessary amount of a second, or supplemental, lubricant that is subsequently applied to the stock by the purchaser prior to further fabrication. It is yet another objective to provide a lubricated sheet product and lubricant composition which avoid the difficulties associated with tenacious lubricant-containing buildup on tooling and with excessive or uneven buildup on the rolls downstream from the lubricant application equipment.

It is another principal objective to provide a petrolatum-free lubricant composition for can body, tab and end stock. Yet another objective of this invention is to provide a lubricant composition with improved performance over the invention set forth in U.S. Pat. No. 5,401,575, the disclosure of which is fully incorporated by reference herein. Particularly, it is a principal objective to provide a lubricant which produces less beer turbidity when such metals are used for beer containers. It is another objective to provide a tab and end stock lubricant composition which provides beers stored in conjunction therewith with better foam retention performance, particularly light beers and cold-filtered beers. It is another objective to provide a lubricant with less migration on the sheet, such as during storage and transport, especially at warmer temperature exposures.

Still other factors critical to the commercial success of can body, tab and end stock, made from aluminum or any other metal according to this invention, include: having a chemical composition and the proper prelube consistency for imparting adequate formability to the metal product as it is being worked; appropriate compatibility with the container's contents (food, beer or beverage) including not imparting an undesirable taste or appearance to the container's contents; being compatible with current application techniques and hardware; and having optimum formability at a minimum applied weight/thickness or rate. On a preferred basis, said lubricant system should enable on-line monitoring of the lubricant coverage being applied to the sheet product using existing technology.

In accordance with the foregoing objectives and advantages, there is provided metal sheet product, more particularly bare and coated tab stock and coated can end and body stock for food, beer and beverages, which has been treated with a lubricant blend consisting essentially of: (i) about 25–90 wt.% of an ester, preferably including individual esters and mixtures of esters containing one or more ester moieties per molecule, with 6 or more carbon atoms, and most preferably bis(2-ethylhexyl)sebacate (or "DOS"); (ii) about 10–75 wt. % of a mixture of a polyalphaolefin and a microcrystalline wax, said mixture typically being a 35:65 to 65:35 blend, by weight, of each component, and a balance of incidental additives and impurities. With the application of said composition/blend, in preferred average thicknesses (or surface coverages) of about 3–110 mg/ft$^2$ for can tab stock and between about 3–35 mg/ft$^2$ for can end and body stock, the invention produces prelubricated can stock in a suitable condition for forming into can tabs, can ends and can bodies without further lubrication. A method for supplying prelubricated can tab, end and body stock is also disclosed.

DETAILED DESCRIPTION OF PREFERRED EMBODIMENTS

In the following detailed description, repeated reference is made to the application of preferred lubricant composition/blends to 3000 and 5000 Series aluminum sheet products (Aluminum Association designation) or products consistent with such designations if not currently registered with the Aluminum Association. It is to be understood, however, that this same composition and method may have other applications to steel and other food, beer and beverage can stock or even certain flexible container stock products, When referring to any numerical value, or range of values throughout this detailed description and the accompanying claims, it is to be understood that each range expressly includes every full and fractional number between the stated range maximum and minimum, such that a compositional blend including about 60–85 wt. % of an ester would cover any prelube-blend having 61, 62, 63 wt. % of that additive, as well as 63.5, 63.7 and 63.9 wt. %, up to and including 84.999 wt. % ester, most preferably DOS. The same applies to all other numerical compositional and performance ranges set forth herein.

A first principal component of the lubricant blend of this invention comprises an ester, preferably including individual esters and mixtures of esters containing one or more ester moieties per molecule, with 6 or more carbon atoms, and most preferably bis(2-ethylhexyl)sebacate, also known generically as dioctyl sebacate or DOS. This compound exists as a diester of a dicarboxylic acid having the general formula: $C_8H_{17}OOC(CH_2)_8COOC_8H_{17}$, or more precisely as: $C_4H_9CH(C_2H_5)CH_2OOC(CH_2)_8COOCH_2CH(C_2H_5)C_4H_9$. It exists in liquid form and has been used alone as a thin layer lubricant for aluminum can stock, but never as a thick layer prelubricating compositional blend that obviates the need to add further (i.e., second) lubricant layers to uncoiled sheet prior to conversion into can tab, end or body parts. As evidenced by the performance data, items D through F in Table II below, other suitable substitutes, in whole or in part, for this ester component include butyl stearate and an acetylated, partially hydrogenated soybean oil, sold by Eastman Chemical Company under the name Myvacet® 9-45.

The second principal component hereof is a polyalphaolefin (or "PAO"), which is a highly refined, synthetic base oil. One suitable version of such material is sold by the Albemarle Corporation as Durasyn® 164. Polyalphaolefins are available in various viscosity levels. For instance, Durasyn® 164 has a viscosity of 4 centistokes (or "cSt") as measured at 100° C., though other Durasyn® variants range in viscosity from as low as about 2 cSt to as high as about 100 cSt or more. It is to be understood, however, that even other commercially available PAOs may be used in combination with the other two lubricant additives of this invention to achieve the superior performance criteria observed with this invention. Suitable substitutes for Albemerle's Durasyn® include the Nexbase 2000 Series as manufactured by Neste Alpha OY, Mobil Chemical Company's Mobil SHF product line of PAOs, Uniroyal Chemical's line of Synton® products and Chevron Chemical Company's Oronite Synfluid® line of polyalphaolefins. It is to be understood that other desired viscosities may also be affected by blending together two or more of the aforementioned polyalphaolefins.

The third principal component hereof is a microcrystalline wax. One suitable version of such material is sold by Witco Corporation as "Witco Multiwax 180W". Said material is light in color and has relatively low levels of impurities contained therein. It also has the further advantage of a relatively high melting point, between about 180°–190° F. It is to be understood, however, that even other commercially available microcrystalline waxes, such as those with melting points of about 165°–190° F., may be used in combination with the other two lubricant additives of this invention to achieve the performance criteria observed with this invention. Suitable substitutes for Witco Multiwax 180W include Witco Multiwax 180M or the Ross 1275 WH product manufactured by Frank B. Ross Co., Inc. And while microcrystalline waxes with lower and higher melting points than those specified above are available, those with melting points below about 150° F. did not perform as well in preliminary foam tests while the latter waxes, with melting points in excess of 195° F. were generally avoided for being too hard to apply and possibly causing excessive tool buildup.

By "incidental additives and impurities", it is meant that the ester or DOS being combined with commercially available PAOs and microcrystalline waxes in accordance with this invention may include small quantities of other constituents. The microcrystalline wax used in comparative studies, for example, had trace amounts (about 5 ppm) of an anti-oxidant. Minor levels of still other additives, both desired and undesired, may be present in any given sampling of constituent parts.

It has been determined through the practice of this invention that the application of a combination of these three lubricants, in preferred ratios of about 2:1:1 wt. % ester:PAO:microcrystalline wax, results in a synergistic effect on overall lubricant performance. That is why preferred embodiments of this method for making prelubed can stock insist on a full blending of the three component parts before applying to clean, sheet product substrate.

Table I that follows details the compositions of three lubricants compared for purposes of this invention. The first of these tested is one of the preferred compositions from U.S. Pat. No. 5,401,575.

TABLE I

| Designation | Composition | Wt % |
|---|---|---|
| A | Amber Petrolatum | 25 |
| | DOS | 75 |
| B | Durasyn ® 164 | 25 |
| | Witco Multiwax 180W | 25 |
| | DOS | 50 |
| C | Durasyn ® 164 | 45 |
| | Witco Multiwax 180W | 10 |
| | DOS | 45 |
| D | Durasyn ® 164 | 25 |
| | Witco Multiwax 180W | 25 |
| | DOS | 50 |
| E | Durasyn ® 164 | 25 |
| | Witco Multiwax 180W | 25 |
| | Butyl Stearate | 50 |
| F | Durasyn ® 164 | 25 |
| | Witco Multiwax 180W | 25 |
| | Myvacet 9-45 | 50 |

The first part of Table II, results A through C, shows the effect of various Table I lubricant compositions on the Coefficients of Friction (or "COF") and Scar Ratings of 5042 aluminum sheet after being subjected to various MOFISS-type tests, MOFISS being an acronym for "Moving Film Stationary Sled" type tests for lubricant/coating coverages. In such tests, a sled resting on a sheet sample makes contact on only the surfaces of fixed ball beatings which slide across the sheet during performance of the test. Results from these tests include COF values, ball scar (scratching and/or pickup on the ball bearings) ratings, and wear track (extent of scuffing/galling on the sheet surface) values. The second half of Table II, results D through F, shows that other ester substitutes for DOS, namely butyl stearate (Lubricant E) and Myvacet 9-45 (Lubricant F) performed as well as those compositions containing DOS.

TABLE II

| | | Room Temp. | | | Heat Stabilized[1] | | |
|---|---|---|---|---|---|---|---|
| Lubricant | Coverage (mg/ft$^2$) | COF | Ball Scar[2] | Wear Track[2] | COF | Ball Scar[2] | Wear Track[2] |
| A | 11.7 | 0.153 | 1.0 | 2.0 | 0.148 | 1.0 | 2.0 |
| | 28.8 | 0.137 | 1.0 | 2.0 | 0.138 | 1.0 | 2.0 |
| B | 13.5 | 0.127 | 1.0 | 2.0 | 0.088 | 0.67 | 1.5 |
| | 29.2 | 0.129 | 1.0 | 2.0 | 0.084 | 1.0 | 1.0 |
| C | 13.9 | 0.152 | 1.0 | 2.25 | 0.135 | 1.33 | 2.75 |
| | 29.2 | 0.140 | 1.0 | 2.0 | 0.118 | 1.0 | 2.0 |
| D | 13 | 0.144 | 1.0 | 2.0 | 0.114 | 1.0 | 2.0 |
| | 31 | 0.131 | 1.0 | 2.0 | 0.092 | 1.0 | 1.5 |
| E | 13 | 0.116 | 1.0 | 2.0 | 0.100 | 1.0 | 2.0 |
| | 30 | 0.108 | 1.0 | 2.0 | 0.086 | 0.8 | 1.5 |
| F | 12 | 0.120 | 0.3 | 2.0 | 0.105 | 1.0 | 2.0 |
| | 29 | 0.106 | 0.2 | 1.5 | 0.086 | 0.7 | 1.5 |

[1]Heat Stabilization performed at 250° F. for 2 hours.
[2]Ranges from 0 (no scar) to 5 (severe scarring).

In Table III, additional tests were performed on the relative migration of sheet products lubricated with the aforementioned compositions.

TABLE III

| | Migration | Migration Extent | | |
|---|---|---|---|---|
| Lubricant | Direction | At Room Temp. | At 100° F. | At 130° F. |
| A | with grain | high | high | v. high |
| | against grain | med | high | high |
| B | with grain | med | med | med-high |
| | against grain | none | none | low |
| C | with grain | high | high | high |
| | against grain | low | low | med |

Finally, Table IV data compares the beer foam collapse performance of the prior art lubricant composition versus the better performing lubricant above, composition B. Note that for this test, the longer time for a beer foam to collapse is better!

TABLE IV

| Lubricant | Foam Collapse time |
|---|---|
| A | 171 |
| B | 229 |

Having described the presently preferred embodiments, it is to be understood that the invention may be otherwise embodied by the scope of the claims appended hereto.

What is claimed is:

1. A bare or coated food, beer or beverage container stock comprising a metal sheet product having first and second surfaces at least one of which comes in contact with food, beer or a beverage and which is lubricated with a petrolatum-free composition made by blending a mixture comprising:

(a) about 10–90% by weight of an ester; and (b) about 10–90 wt. % of a blend, said blend comprising:

(i) about 10–95 wt. % of a polyalphaolefin; and (ii) about 5–90 wt. % of a microcrystalline wax.

2. The sheet product of claim 1 wherein the metal is an aluminum alloy.

3. The sheet product of claim 2 wherein said alloy contains magnesium.

4. The sheet product of claim 2 wherein the container stock is a food, beer or beverage can tab stock and said alloy is selected from the group consisting of: 5017, 5042, 5052, 5082, 5182 and 5352 aluminum (Aluminum Association designation).

5. The sheet product of claim 4 wherein the surface of said can tab stock is lubricated with about 3–200 mg/ft$^2$ of said composition.

6. The sheet product of claim 2 wherein the container stock is a food, beer or beverage can end stock and said alloy is selected from the group consisting of: 5017, 5042, 5052, 5082, 5182 and 5352 aluminum (Aluminum Association designation).

7. The sheet product of claim 6 wherein the surface of said can end stock is lubricated with about 3–35 mg/ft$^2$ of said composition.

8. The sheet product of claim 2 wherein the container stock is a beer or beverage can body stock and said alloy is selected from the group consisting of: 3004, 3104 and 3204 aluminum (Aluminum Association designation).

9. The sheet product of claim 2 wherein the container stock is flexible container packaging stock and said alloy is selected from the group consisting of: 1100, 1145, 3003 and 8111 aluminum (Aluminum Association designation).

10. The sheet product of claim 1 wherein at least one metal surface is coated with a thin polymeric coating.

11. The sheet product of claim 1 wherein the composition is applied by a process selected from the group consisting of: electrostatic deposition; roll coating; application from a solution of lubricant and solvent, and application of a mixture of lubricant and water.

12. The sheet product of claim 1 wherein the ester contains one or more ester moieties per molecule and having at least 6 carbon atoms.

13. The sheet product of claim 12 wherein the ester consists essentially of bis(2-ethylhexyl)sebacate.

14. The sheet product of claim 1 wherein the ester is selected from the group consisting of: bis(2-ethylhexyl) sebacate; butyl stearate; and an acetylated, partially hydrogenated soybean oil.

15. The sheet product of claim 1 wherein the composition includes at least about 30 wt. % bis(2-ethylhexyl)sebacate.

16. The sheet product of claim 1 wherein the blend consists essentially of about 35–65 wt. % polyalphaolefin and about 65–35 wt. % microcrystalline wax.

17. The sheet product of claim 1 wherein the composition consists essentially of about 50 wt. % bis(2-ethylhexyl) sebacate, about 25 wt. % polyalphaolefin; and about 25 wt. % microcrystalline wax.

18. The sheet product of claim 1 wherein said microcrystalline wax has a melting point between about 165°–190° F.

19. Food, beer or beverage can tab stock comprising a metal sheet product having a first and second surface, at least one surface of which contacts with food, beer or a beverage and which is treated with about 3–2000 mg/ft$^2$ of a petrolatum free made by blending a mixture consisting essentially of:

(a) about 30–70 wt. % of an ester selected from the group consisting of: bis(2-ethylhexyl)sebacate, butyl stearate, and an acetylated, partially hydrongenated soybean oil;

(b) about 15–65 wt. % of a polyalphaolefin; and (c) about 5–45 wt. % of a microcrystalline wax.

20. The tab stock of claim 19 wherein said lubricant consists essentially of about 50 wt. % bis(2-ethylhexyl) sebacate, about 25 wt. % polyalphaolefin; and about 25 wt. % microcrystalline wax.

21. The tab stock of claim 19 which is made from an alloy selected from the group consisting of: 5017, 5042, 5052, 5082, 5182 and 5352 aluminum (Aluminum Association designation).

22. The tab stock of claim 19 wherein said lubricant is applied at an average thickness of about 4–110 mg/ft$^2$.

23. The tab stock of claim 22 wherein said lubricant is applied at an average thickness of about 5–70 mg/ft$^2$.

24. The tab stock of claim 19 wherein said microcrystalline wax has a melting point between about 165°–190° F.

25. Food, beer, or beverage can end or body stock comprising a metal sheet product having a first and second coated surface, at least one surface of which contacts with food, beer or a beverage and which is covered with about 3–35 mg/ft$^2$ of a petrolatum free lubricant made by blending a mixture consisting essentially of:

(a) about 30–70 wt. % of an ester selected from the group consisting of: bis(2-ethylhexyl)sebacate, butyl stearate, and an acetylated, partially hydrogenated soybean oil;

(b) about 15–65 wt. % of a polyalphaolefin; and (c) about 5–45 wt. % of a microcrystalline wax.

26. The can end or body stock of claim 25 wherein said lubricant consists essentially of about 50 wt. % bis(2-ethylhexyl)sebacate, about 25 wt. % polyalphaolefin; and about 25 wt. % microcrystalline wax.

27. The can end or body stock of claim 25 wherein said metal sheet product is selected from the group consisting of: 3004, 3104, 3204, 5017, 5042, 5052, 5082, 5182 and 5352 aluminum (Aluminum Association designation).

28. The can end or body stock of claim 25 wherein said lubricant is applied at an average thickness of about 4–18 mg/ft$^2$.

29. The can end or body stock of claim 25 wherein said microcrystalline wax has a melting point between about 165°–190° F.

* * * * *

UNITED STATES PATENT AND TRADEMARK OFFICE

CERTIFICATE OF CORRECTION

PATENT NO. : 5,672,401

DATED : September 30, 1997

INVENTOR(S) : James R. Anglin et al.

It is certified that error appears in the above-identified patent and that said Letters Patent is hereby corrected as shown below:

| | |
|---|---|
| Col. 7, line 31, Claim 19 | Before mg/ft$^2$, delete "3-2000" and insert --3-200-- |
| Col. 7, line 32, Claim 19 | After petrolatum free, insert --lubricant-- |

Signed and Sealed this

Tenth Day of March, 1998

*Attest:*

*Attesting Officer*

Bruce Lehman

BRUCE LEHMAN

*Commissioner of Patents and Trademarks*